US005461978A

United States Patent [19]

Chou

[11] Patent Number: 5,461,978

[45] Date of Patent: Oct. 31, 1995

[54] PRINTING PRESS

[76] Inventor: Ching-Ho Chou, No. 168, Pao-Chung-Erh St., Hou-Hu Li, Chia-Yi City, Taiwan

[21] Appl. No.: 312,645

[22] Filed: Sep. 27, 1994

[51] Int. Cl.[6] ..... B41F 13/24

[52] U.S. Cl. ..... 101/248; 101/216; 101/247; 101/185

[58] Field of Search ..... 101/185, 216, 101/247, 248, 351, 352, DIG. 36, 486, 182, 184, 145

[56] References Cited

U.S. PATENT DOCUMENTS

| | | | |
|---|---|---|---|
| 2,832,287 | 4/1958 | Greenwood | 101/248 |
| 3,169,473 | 2/1965 | Irwin et al. | 101/248 X |
| 3,320,876 | 5/1967 | Salvatore | 101/248 X |
| 3,731,620 | 5/1973 | Klemmer | 101/247 X |
| 3,791,294 | 2/1974 | Skelding et al. | 101/248 |
| 3,986,454 | 10/1976 | Granger | 101/247 X |
| 4,132,166 | 1/1979 | Bugnone | 101/247 |
| 4,137,845 | 2/1979 | Jeschke | 101/248 |
| 4,503,771 | 3/1985 | Herzel et al. | 101/247 |
| 5,188,027 | 2/1993 | Fantoni | 101/216 |
| 5,201,272 | 4/1993 | Simon | 101/216 X |

FOREIGN PATENT DOCUMENTS

| | | | |
|---|---|---|---|
| 0167458 | 12/1981 | Japan | 101/248 |

*Primary Examiner*—Chris A. Bennett
*Attorney, Agent, or Firm*—Christie, Parker & Hale

[57] ABSTRACT

A printing press includes two opposite mounting walls formed with aligned horizontally extending openings in which two sliding seats are mounted slidably and respectively, a printing roller extending horizontally between the mounting walls and having a longitudinal axis and two opposite ends mounted rotatably and respectively to the sliding seats, a printing plate unit mounted securely on the printing roller, a first retaining assembly provided on one of the mounting walls for retaining releasably a first one of the sliding seats in a desired position in the respective opening, and a second retaining assembly provided on the other one of the mounting walls for retaining releasably a second one of the sliding seats in a desired position in the respective opening. The retaining assemblies are actuated simultaneously to cause longitudinal sliding movement of the sliding seats within the openings so as to result in movement of the longitudinal axis of the roller relative to the mounting walls in a direction parallel to the mounting walls. Actuation of the second retaining assembly without actuating the first retaining assembly causes longitudinal sliding movement of the second one of the sliding seats within the respective opening so as to vary an angle formed between the longitudinal axis of the printing roller and one of the mounting walls.

10 Claims, 10 Drawing Sheets

PRINTING PRESS

BACKGROUND OF THE INVENTION

1. Field of the Invention

This invention relates to a printing press, more particularly to a printing press which obviates the need for interrupting the rotation of a printing roller thereof when adjustments are being made to move the printing roller to a desired position.

2. Description of the Related Art

A printing press has a printing roller on which a printing plate unit is mounted. The printing plate unit rotates synchronously with the printing roller so as to print something onto a printing paper. The printing roller is usually moved to a desired position in order to ensure proper printing of the printing paper. Generally, the printing press includes first, second and third adjusting assemblies. The first adjusting assembly can be actuated to move the printing roller in a direction perpendicular to the longitudinal axis of the printing roller. The second adjusting assembly can be actuated to move the printing roller in a direction parallel to the longitudinal axis of the printing roller. The third adjusting assembly can be actuated to vary an angle formed between the printing plate unit and the longitudinal axis of the printing roller.

Referring to FIG. 1, a conventional printing press 1 is shown to comprise a base support 11. At least one printing assembly 12 is mounted movably on the base support 11. The number of printing assemblies 12 mounted on the base support 11 depends on the number of colors to be printed. Each printing assembly 12 includes two opposite mounting walls 123 and a printing roller 122 which extends horizontally between the mounting walls 123. A printing plate unit (not shown) is mounted on the printing roller 122. In order to correspond the printing plate unit with the printing paper (not shown) to be conveyed into the printing assembly 12, each printing assembly 12 further includes a first adjusting assembly 13, a second adjusting assembly 14 and a third adjusting assembly 15.

Referring to FIGS. 1, 2 and 3, the first adjusting unit 13 includes an actuating rod 132 which extends transversely between two spaced parallel frame portions 111 of the base support 11. One end of the actuating rod 132 extends on one side of the base support 11 and has a hand wheel 131 mounted securely thereon. Two driving gears 133 are mounted securely on the actuating rod 132 and mesh respectively with a driven gear 134. Each of the driven gears 134 is mounted securely on a threaded rod 135. Each of the threaded rods 135 has a mounting seat 136 mounted threadably thereon. The mounting walls 123 are mounted on the mounting seats 136. In operation, rotation of the hand wheel 131 causes corresponding rotation of the actuating rod 132 and the driving gears 133 so as to result in corresponding rotation of the driven gears 134 and the threaded rods 135 in order to move the mounting seats 136 along the respective threaded rods 135, thereby moving the mounting walls 123 relative to the base support 11 in a direction parallel to the mounting walls 123. Movement of the mounting walls 123 results in movement of a longitudinal axis of the printing roller 122 in the direction parallel to the mounting walls 123.

Referring to FIGS. 1 and 4, the second adjusting assembly 14 includes an adjusting rod 142 which extends threadably through a fixed seat 124 mounted on one of the mounting walls 123 and which has a first end portion connected to a bearing 144 on one end of the printing roller 122 and a second end portion extending on one side of the mounting wall 123 opposite to the printing roller 122. A knob 141 is mounted securely on the second end portion of the adjusting rod 142. A stop nut 143 is mounted threadably on the adjusting rod 142 and abuts against the fixed seat 124. In operation, the stop nut 143 is initially moved away from the fixed seat 124. The knob 141 is rotated so as to cause corresponding rotation of the adjusting rod 142. Rotation of the adjusting rod 142 results in longitudinal movement thereof in the direction perpendicular to the mounting walls 123 so as to cause corresponding movement of the printing roller 122. At this time, if the printing plate unit on the printing roller 122 still does not correspond with the printing paper after the actuation of the first and second adjusting assemblies 13,14, actuation of the third adjusting assembly 15 is needed.

Referring to FIGS. 1, 5 and 6, the third adjusting assembly 15 includes four adjusting units 150 which are mounted correspondingly on two inclined surfaces 125 of the printing roller 122. Each of the adjusting units 150 includes a hook member 152 which is retained on the printing roller 122 by means of a press block 151. The press block 151 has a groove within which a base portion of the hook member 152 is received. A hook portion of the hook member 152 extends through a positioning hole 154 of a plate member 153 which is located on the press block 151 and which is coupled to one end of the printing plate unit 16. An adjusting rod 155 extends into the groove and is connected threadably to the base portion of the hook member 152 such that rotation of the adjusting rod 155 results in longitudinal movement of the hook member 152 along the adjusting rod 155. Movement of the hook member 152 causes corresponding movement of the plate member 153, thereby moving the printing plate unit 16 correspondingly. Therefore, rotating the four adjusting rods 155 of the four adjusting units 150 results in movement of the hook members 152, thereby pivoting the printing plate unit 16 relative to the printing roller 122 so as to vary an angle formed between the longitudinal axis of the printing roller 122 and the printing plate unit 16.

From the above disclosure, the position of the printing plate unit 16 relative to the mounting walls 123 must be adjusted by operating the adjusting assemblies 13,14,15 after installation. Since the structures of the adjusting assemblies 13,14,15 are relatively complicated, it is inconvenient to move the printing plate unit 16 to a desired position. For example, four adjusting rods 155 must be rotated simultaneously when varying the angle formed between the longitudinal axis of the printing roller 122 and the printing plate unit 16. In addition, since the four adjusting units 150 are mounted directly on the printing roller 122, the rotation of the printing roller 122 must be interrupted when operating the third adjusting units 15, thereby lowering the adjusting efficiency.

SUMMARY OF THE INVENTION

Therefore, the main objective of the present invention is to provide a printing press which obviates the need for interrupting the rotation of a printing roller thereof when adjustments are being made to move the printing roller to a desired position.

According to the present invention, a printing press includes two opposite mounting walls which are formed with aligned horizontally extending openings, two sliding seats which are mounted slidably and respectively in the horizontally extending openings, a printing roller which extends horizontally between the mounting walls and which has a longitudinal axis and two opposite ends mounted rotatably and respectively to the sliding seats, a printing plate unit which is mounted securely on the printing roller, a first retaining assembly which is provided on one of the mounting walls for retaining releasably a first one of the sliding seats in a desired position in the respective opening, and a second retaining assembly which is provided on the other one of the mounting walls for retaining releasably a second one of the sliding seats in a desired position in the respective opening. The first and second retaining assemblies are actuated simultaneously to cause longitudinal sliding movement of the sliding seats within the openings so as to result in movement of the longitudinal axis of the printing roller relative to the mounting walls in a first direction parallel to the mounting walls. Actuation of the second retaining assembly without actuating the first retaining assembly causes longitudinal sliding movement of the second one of the sliding seats within the respective opening so as to vary an angle formed between the longitudinal axis of the printing roller and one of the mounting walls.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
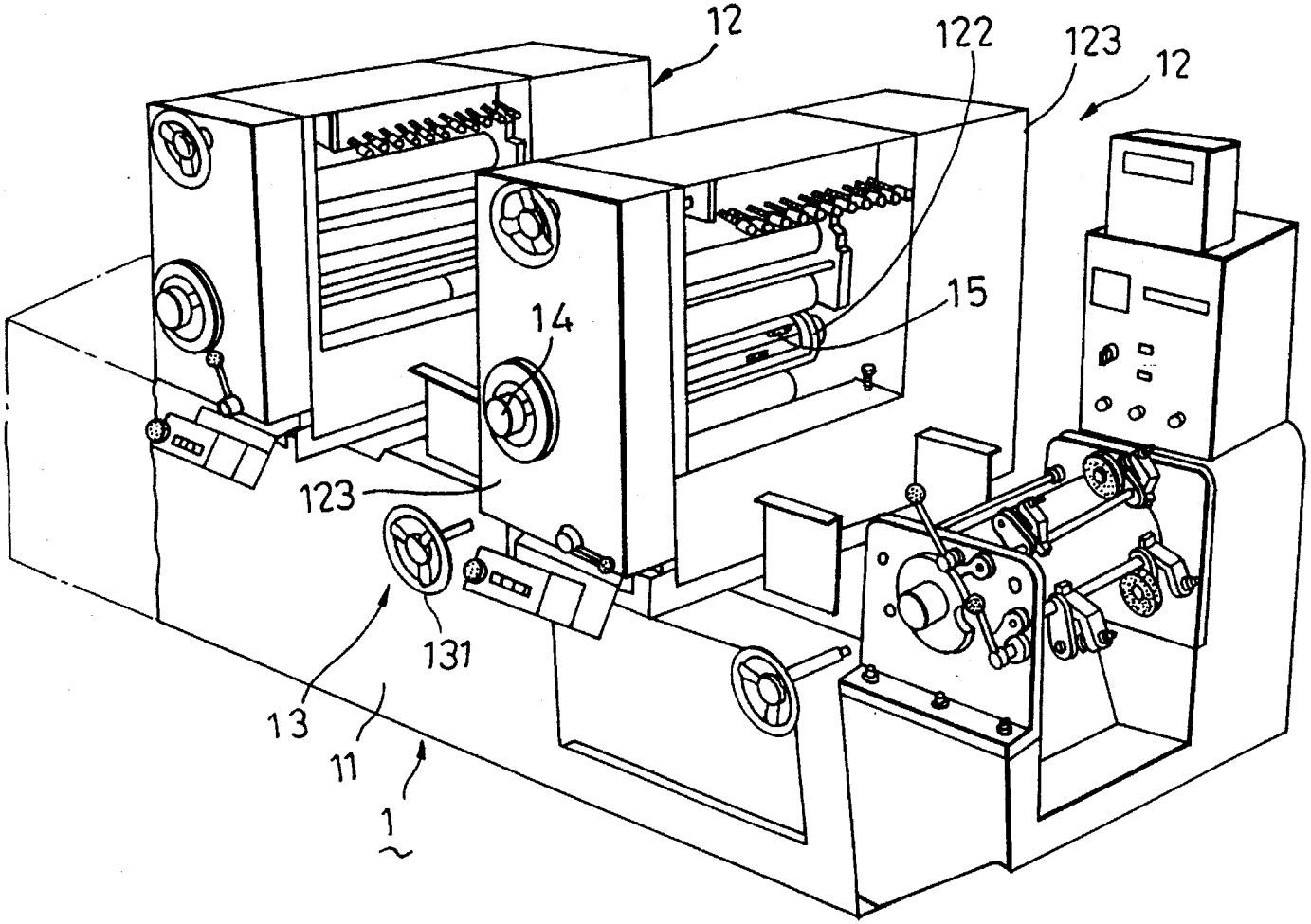
FIG. 1 (PRIOR ART)
FIG. 1 is a schematic perspective view of a conventional printing press.
Figure 2:
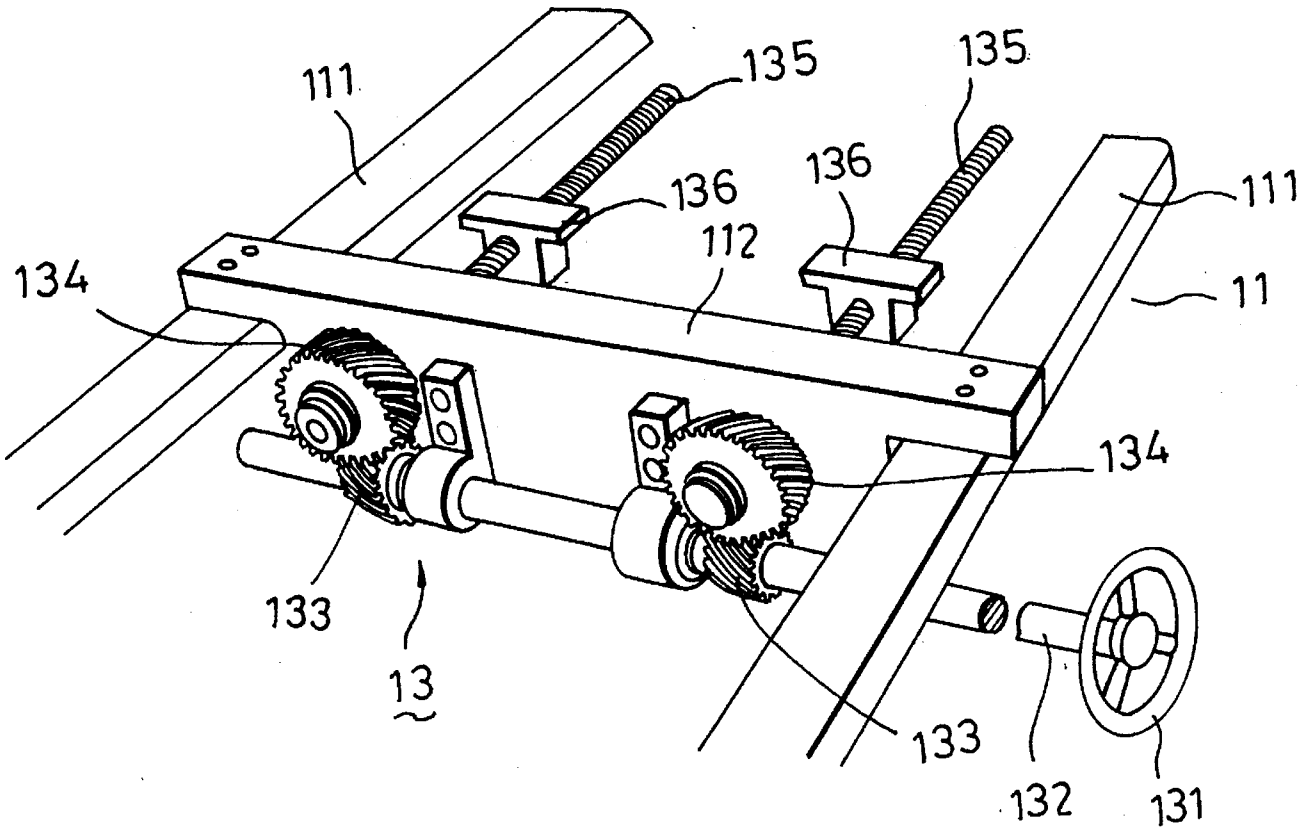
FIG. 2 (PRIOR ART)
FIG. 2 is a schematic perspective view of a part of a first adjusting unit of the conventional printing press.
Figure 3:
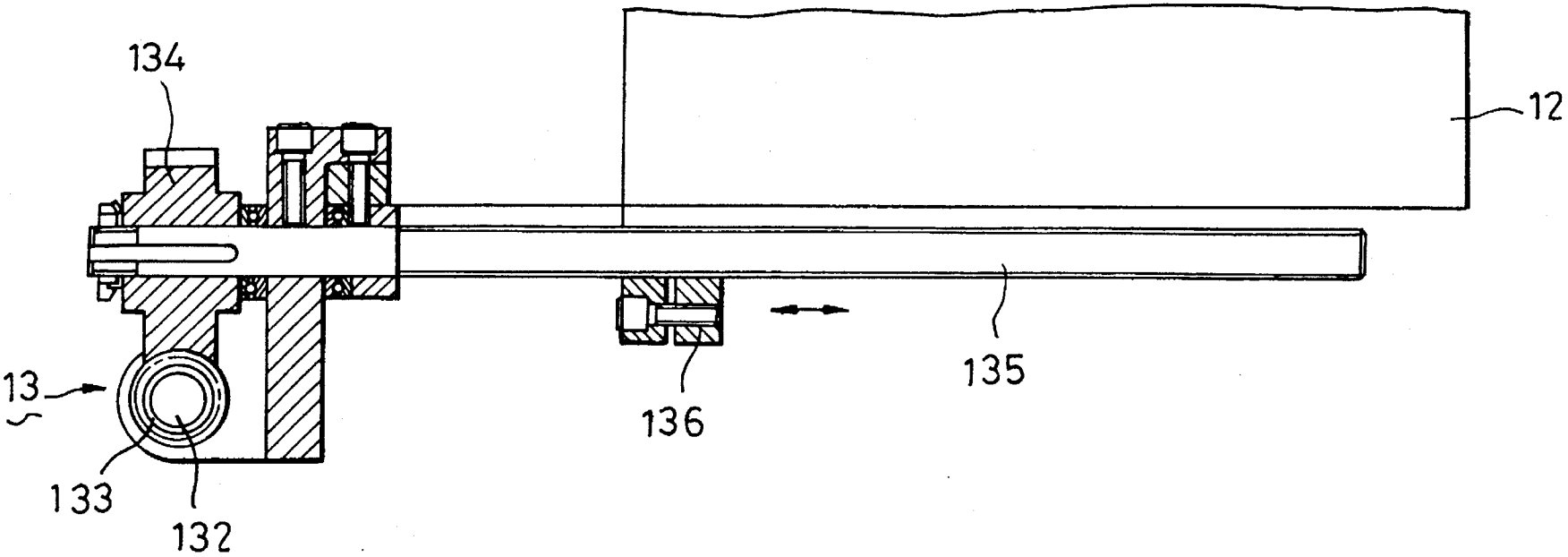
FIG. 3 (PRIOR ART)
FIG. 3 is a schematic sectional view of a part of the conventional printing press.
Figure 4:
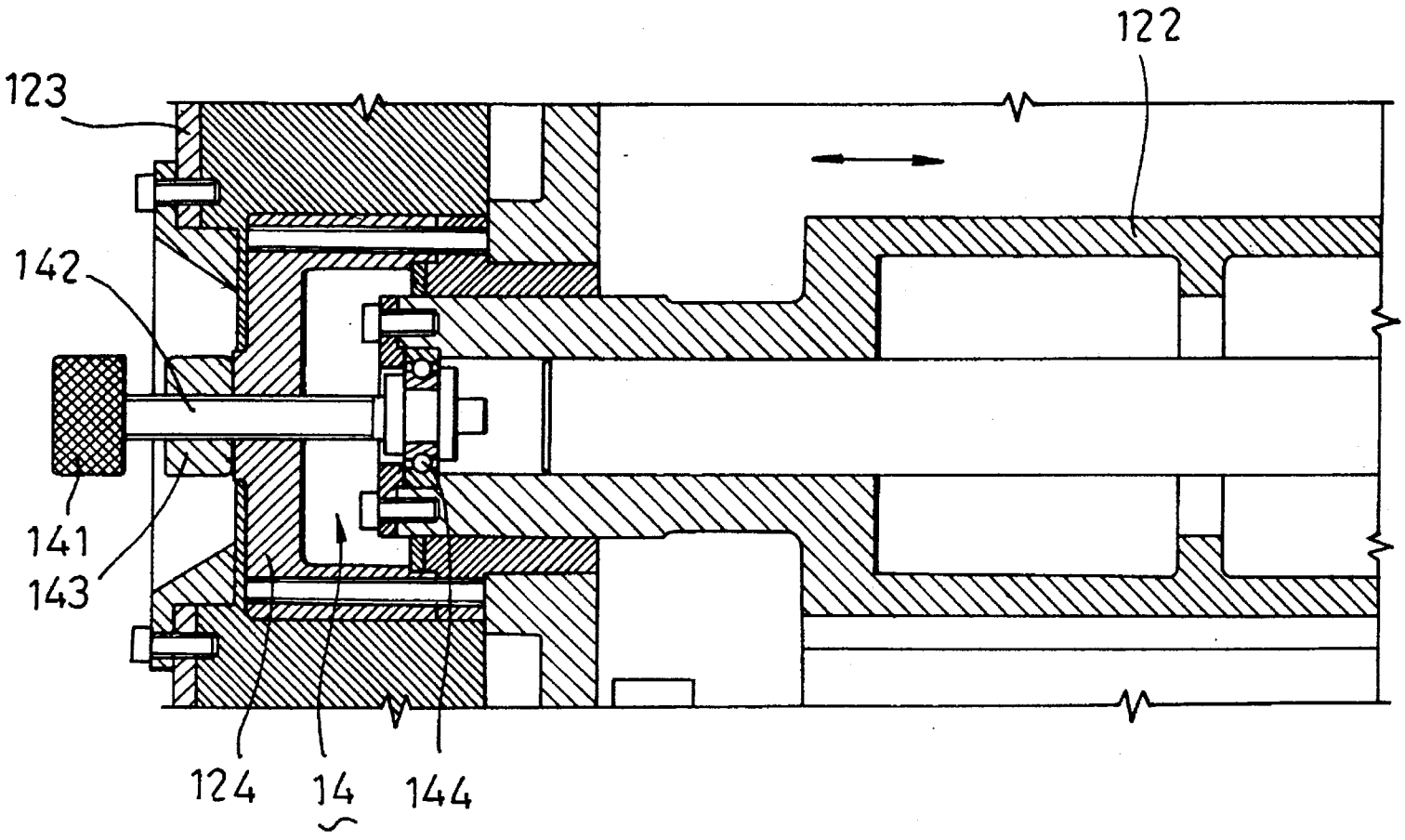
FIG. 4 (PRIOR ART)
FIG. 4 is a schematic sectional view of a second adjusting unit of the conventional printing press.
Figure 5:
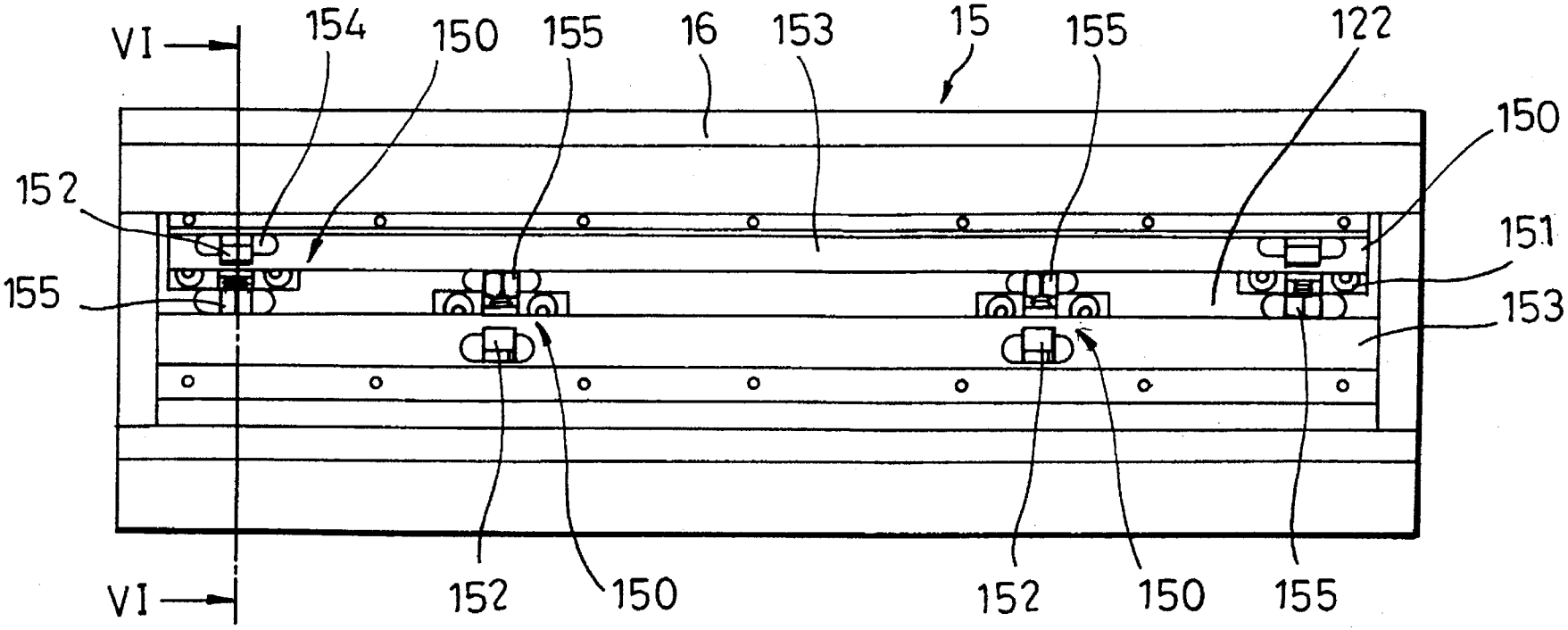
FIG. 5 (PRIOR ART)
FIG. 5 is a schematic view showing a printing roller of the conventional printing press.
Figure 6:
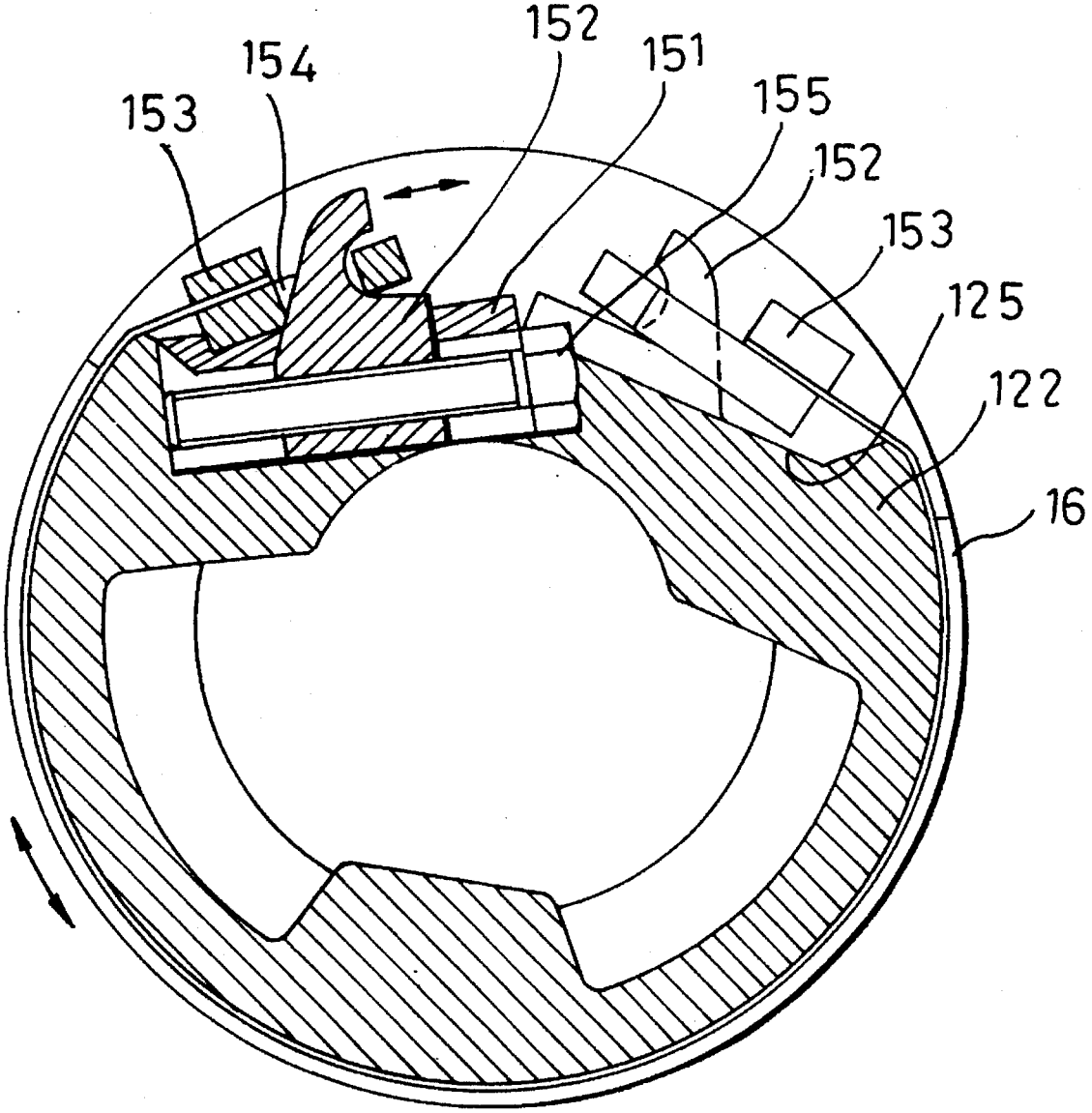
FIG. 6 (PRIOR ART)
FIG. 6 is a cross-sectional view of the printing roller taken along the line VI—VI in FIG. 5.
Figure 7:
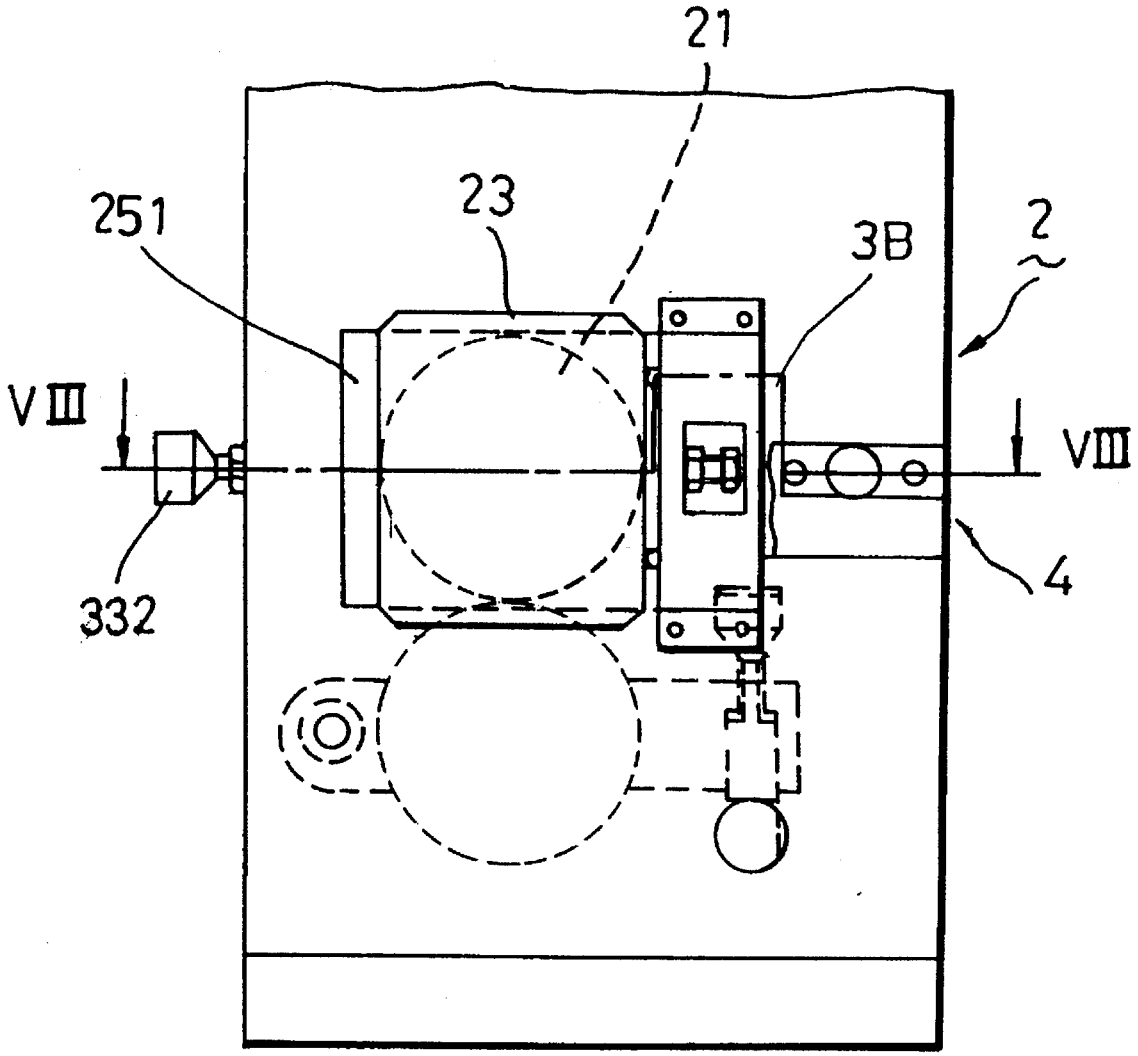
FIG. 7 is a side view of a part of a printing press according to the present invention.
Figure 8:
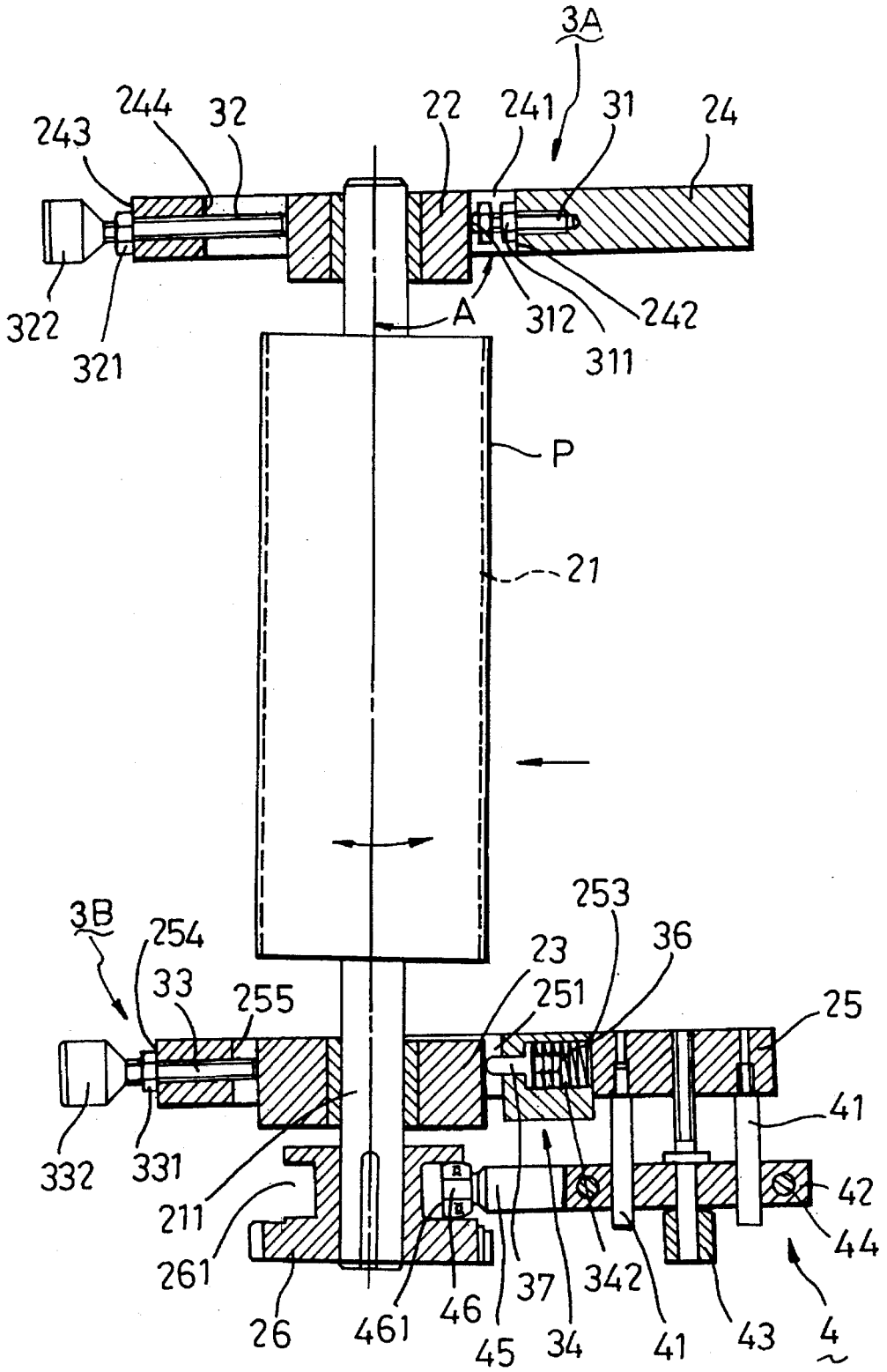
FIG. 8 is a cross-sectional view taken along the line VIII—VIII in FIG. 7.

Referring to FIGS. 7 and 8, a printing press according to the present invention includes at least one printing assembly 2, depending on the number of colors to be printed. Each printing assembly 2 is adapted to be mounted on a base support (not shown) of the printing press, which base support is similar to that described beforehand. Two opposite mounting walls 24,25 are spaced apart from each other and are formed with aligned horizontally extending openings 241,251. Each of the mounting walls 24,25 has a distal vertical end face 243,254 and a periphery which defines the opening 241,251 and which includes two opposite vertical walls 244,242 and 255,253. Two sliding seats 22,23 are mounted slidably and respectively in the horizontally extending openings 241,251. A printing roller 21 extends horizontally between the mounting walls 24,25 and has a longitudinal axis (shown in phantom lines) and two opposite ends 211 which are mounted rotatably and respectively to the sliding seats 22,23. A printing plate unit (P) is mounted securely on the printing roller 21. One of the opposite ends 211 of the printing roller 21 extends through the sliding seat 23 and has a driving gear 26 which is mounted securely thereon and which is driven to rotate so as to cause corresponding rotation of the printing roller 21. The driving gear 26 has an annular outer wall formed with a peripheral groove 261.

A first retaining assembly (3A) is provided on the mounting wall 24 for retaining releasably the sliding seat 22 in a desired position in the opening 241. The first retaining assembly includes a first threaded rod 31 which has a first end portion that extends threadably into the mounting wall 24 at the vertical wall 242 and a second end portion that extends into the opening 241 and that has a curved end surface 312 which abuts against one of two opposite sides of the sliding seat 22. The first threaded rod 31 has a stop nut 311 which is connected threadably to the second end portion thereof and which abuts against the vertical wall 242 of the mounting wall 24. The first retaining assembly (3A) further includes a second threaded rod 32 which has a first end portion that extends threadably from the distal vertical end face 243 through the vertical wall 244 and into the opening 241 and that abuts against the other one of the opposite sides of the sliding seat 22. The second threaded rod 32 further has a second end portion which extends outside the mounting wall 24 and which is provided with a knob 322 and a stop nut 321 which is connected threadably to the second end portion thereof and which abuts against the distal vertical end face 243 of the mounting wall 24.

Figure 9:
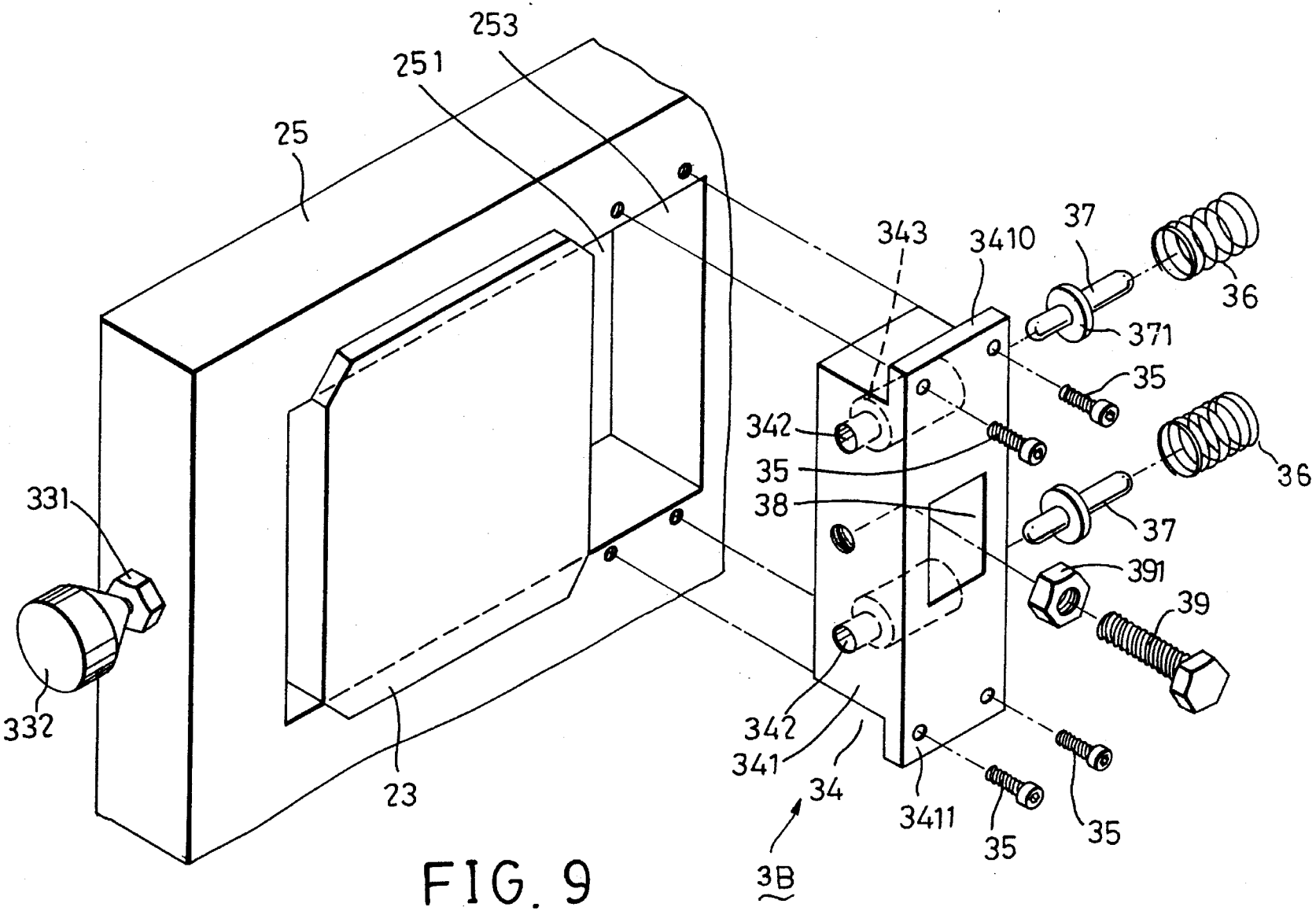
FIG. 9 is an exploded view showing one of the retaining assemblies of the printing press according to the present invention.

Referring now to FIGS. 7, 8 and 9, a second retaining assembly (3B) is provided on the mounting wall 25 for retaining releasably the sliding seat 23 in a desired position in the opening 251. The second retaining assembly (3B) includes a spring-loaded pin unit 34 and a threaded rod 33. The pin unit 34 includes a positioning seat 341 formed with upper and lower through holes 342 which extend in a first direction parallel to the mounting walls 24,25 and which have a diameter-reduced portion so as to define a shoulder portion 343 adjacent the diameter-reduced portion. An upper locking flange 3410 extends upwardly from a top end of the positioning seat 341. A lower locking flange 3411 extends downwardly from a bottom end of the positioning seat 341 and is located opposite to the upper locking flange 3410. The positioning seat 341 is retained within the opening 251 adjacent to the vertical wall 253 by means of locking bolts 35 which extend through the corresponding locking flanges 3410,3411 and into the mounting wall 25. Each of the upper and lower through holes 342 has a pin 37 and a high strength spring 36 received therein. Each pin 37 has an end portion extending through the diameter-reduced portion of the corresponding through hole 342 and into the opening 251 and is formed with a radially extending flange 371 which is sized to prevent extension thereof into the diameter-reduced portion of the corresponding through hole 342. The spring 36 abuts against the vertical wall 253 at one end thereof and abuts against the radially extending flange 371 at the other end thereof so as to normally bias the radially extending flange 371 against the shoulder portion 343 in order to normally extend the end portion of the pin 37 into the opening 251 so as to abut against a first one of two opposite sides of the sliding seat 23. The positioning seat 341 is further formed with a receiving hole 38 which extends in a second direction perpendicular to the mounting walls 24,25. A threaded bolt 39 is received in the receiving hole 38 and has an end portion extending threadably through the positioning seat 341 and into the opening 251 in the first direction parallel to the mounting walls 24,25. A stop nut 391 is connected threadably to the end portion of the threaded bolt 39 and abuts against one of the walls that define the receiving hole 38. The second retaining assembly (3B) further includes a threaded rod 33 which has a first end portion that extends threadably from the distal vertical end face 254 through the vertical wall 255 and into the opening 251 and that abuts against the other one of the opposite sides of the sliding seat 23. The threaded rod 33 further has a second end portion that extends outside the mounting wall 25 and that is provided with a knob 332. A stop nut 331 is connected threadably to the second end portion of the threaded rod 33 and abuts against the distal vertical end face 254 of the mounting wall 25.

Figure 10:
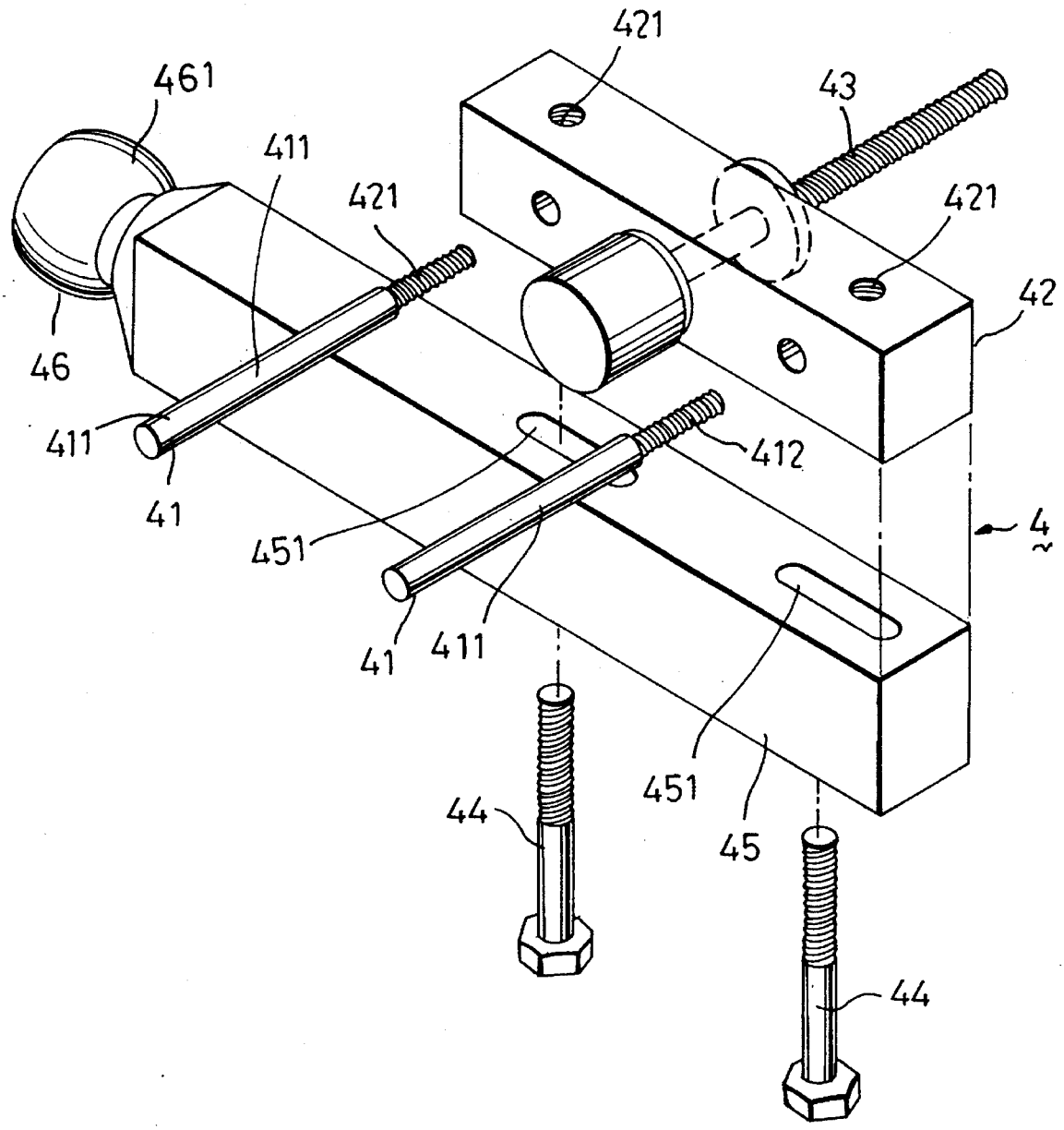
FIG. 10 is an exploded view showing a part of another one of the retaining assemblies of the printing press according to the present invention.

Referring to FIGS. 7, 8 and 10, a pair of mounting rods 41, which extend in the second direction perpendicular to the mounting walls 24,25 and which are located adjacent to the driving gear 26, are connected threadably to the mounting wall 25 by the extension of threaded end portions 412 of the mounting rods 41 into the mounting wall 25. A movable seat 42 is mounted slidably on smooth portions 411 of the mounting rods 41 and is movable toward and away from the mounting wall 25. The movable seat 42 has two vertically extending locking holes 421 formed therethrough. A coupling rod 45 has a first end portion which is formed with two longitudinally extending adjusting slots 451 that are aligned correspondingly with the locking holes 421 of the movable seat 42. Each of two locking bolts 44 extends through a respective one of the adjusting slots 451 and into a respective one of locking holes 421 so as to secure releasably the coupling rod 45 to the movable seat 42. The coupling rod 45 further has a second end portion which extends into the peripheral groove 261 of the driving gear 26 and which has a bearing 46 mounted thereon. The bearing 46 has an outer face 461 that is in contact with the driving gear 26. A third retaining assembly 4 includes an adjusting rod 43 which has a threaded end portion connected threadably to the mounting wall 25 and a head portion connected to the movable seat 42.

Referring to FIGS. 7 and 8, in assembly, the sliding seat 22 is mounted slidably in the horizontally extending opening 241 of the mounting wall 24 and is retained in a desired position-relative to the mounting wall 24 by the first and second threaded rod 31,32. The sliding seat 23 is mounted slidably in the horizontally extending opening 251 of the mounting wall 25 and is retained in a desired position relative to the mounting wall 25 by the threaded-rod 33 and the pins 37 of the spring-loaded pin unit 34. It should be noted that the longitudinal axis of the printing roller 21 and the mounting wall 24 cooperatively form an angle (A) therebetween.

To move the longitudinal axis of the printing roller 21 in the first direction, the first and second retaining assemblies (3A,3B) must be actuated simultaneously. The stop nuts 311,321 are initially rotated so as to move away from the vertical wall 242 and the distal vertical end face 243. The first and second threaded rods 31 and 32 are then rotated so as to cause longitudinal movement thereof in the same direction, thereby resulting in longitudinal sliding movement of the sliding seat 22 within the opening 241. After the sliding seat 22 has been moved to a desired position, the stop nuts 311,321 are rotated to abut against the vertical wall 242 and the distal vertical end face 243, thereby preventing accidental movement of the first and second threaded rods 31 and 32. The stop nut 331 is then moved away from the distal vertical end face 254 of the mounting wall 25. The knob 332 is rotated so as to cause corresponding rotation of the threaded rod 33 in order to result in longitudinal movement of the threaded rod 33, thereby resulting in longitudinal sliding movement of the sliding seat 23 within the opening 251. Movement of the sliding seat 23 within the opening 251 can be achieved by actuating only the knob 332 of the threaded rod 33 since the pins 37 are biased by the springs 36 to normally abut against the sliding seat 23. After the sliding seat 23 has been moved to a desired position, the stop nut 331 is rotated to abut against the distal vertical end face 254, thereby preventing accidental movement of the threaded rod 33. This illustrates how movement of the longitudinal axis of the printing roller 21 relative to the mounting walls 24,25 in the first direction is achieved.

At this time, if a small angular deviation between the printing plate unit (P) on the printing roller 21 and the printing paper (not shown) occurs, the threaded rod 33 can be actuated without operating the first and second threaded rods 31,32 so as to cause longitudinal sliding movement of the sliding seat 23 within the opening 251 in order to permit pivotal movement of the printing roller 21, along with the sliding seat 22, about the second end portion of the first threaded rod 31, thereby varying the angle (A) formed between the longitudinal axis of the printing roller 21 and the mounting wall 24.

In order to move the printing roller 21 relative to the mounting walls 24,25 in the second direction, the adjusting rod 43 is rotated so as to cause longitudinal movement thereof in order to move the movable seat 42 toward and away from the mounting wall 25, thereby resulting in corresponding movement of the coupling rod 45. Movement of the coupling rod 45 results in corresponding movement of the driving gear 26 and the printing roller 21 since the bearing 46 on the second end portion of the coupling rod 45 abuts against the driving gear 26.

The purpose of mounting a bearing 46 on the second end portion of the coupling rod 45 is to minimize friction between the second end portion of the coupling rod 45 and the driving gear 26 during the rotation of the driving gear 26. The outer face 461 of the bearing 46 is curved so as to permit engagement of the coupling rod 45 and the driving gear 26 when the axis of the driving gear 26 is not perpendicular to the axis of the coupling rod 45 after pivotal movement of the printing roller 21. In order to ensure that the second end portion of the coupling rod 45 can extend into the peripheral groove 261 of the driving gear 26 after the printing roller 21 has pivoted away from the coupling rod 45 by a relatively large distance, the locking bolts 44 are released so as to permit movement of the coupling rod 45 relative to the movable seat 42 in order to correspond the bearing 46 with the peripheral groove 261 of the driving gear 26. It should be noted that the printing roller 21 can keep on rotating during the actuation of either one of the first, second and third retaining assemblies (3A,3B,4). It should also be noted that when the sliding seat 23 is moved to a position where the pins 37 of the pin unit 34 are not able to abut against the sliding seat 23, the threaded bolt 39 is rotated so as to cause longitudinal movement thereof in order to push the sliding seat 23 toward the pins 37.

According to the above description, the first and second retaining assemblies (3A,3B) are actuated simultaneously to cause longitudinal sliding movement of the sliding seats 22,23 within the openings 241,251 so as to result in movement of the longitudinal axis of the printing roller 21 relative to the mounting walls 24,25 in the first direction. Actuation of the second retaining assembly (3B) without actuating the first retaining assembly (3A) causes longitudinal sliding movement of the sliding seat 23 within the opening 251 so as to vary the angle (A) formed between the longitudinal axis of the printing roller 21 and the mounting wall 24. The first, second and third retaining assemblies (3A,3B,4) are simple in construction and are easy to operate. More importantly, the printing roller 21 can keep on rotating when either one of the first, second and third retaining assemblies (3A,3B,4) is being actuated, thus facilitating adjustment of the printing roller 21 to a desired position.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A printing press comprising:

two opposite mounting walls formed with aligned openings wherein a first one of said mounting walls has a distal vertical end face and a periphery which defines said opening and which includes two opposite vertical walls;

two sliding seats mounted slidably and respectively in said openings wherein a first one of said sliding seats has a first side opposite a first one of said vertical walls and a second side opposite a second one of said vertical walls;

a printing roller having a longitudinal axis extending between said mounting walls and further having two opposite ends mounted rotatably and respectively to said sliding seats;

a printing plate unit mounted to said printing roller;

a first retaining assembly provided on said first one of said mounting walls for retaining releasably said first one of said sliding seats in a desired position in the respective said opening, said first retaining assembly including a first threaded rod which has a first end portion that extends threadably into said first one of said mounting walls at said first one of said vertical walls and a second end portion that extends into the respective said opening and that abuts against said first side of said first one of said sliding seats, and a second threaded rod which has a first end portion that extends threadably from said distal vertical end face through said second one of said vertical walls and into the respective said opening and that abuts against the second side of said first one of said sliding seats, said second threaded rod further having a second end portion that extends outside said first one of said mounting walls and that is provided with a knob; and a second retaining assembly provided on a second one of said mounting walls for retaining releasably a second one of said sliding seats in a desired position in the respective said opening;

whereby, said first and second retaining assemblies are actuated simultaneously to cause longitudinal sliding movement of said sliding seats within said openings so as to result in movement of said longitudinal axis of said printing roller relative to said mounting walls in a direction parallel to said mounting walls, actuation of said second retaining assembly without actuating said first retaining assembly causing longitudinal sliding movement of said second one of said sliding seats within the respective said opening so as to vary an angle formed between said longitudinal axis of said printing roller and said one of said mounting walls.

2. A printing press as claimed in claim 1, wherein said second end portion of said first threaded rod has a curved end surface.

3. A printing press as claimed in claim 1, wherein said first threaded rod has a stop nut which is connected threadably to said second end portion thereof and which abuts against said first one of said vertical walls of said one of said first mounting walls.

4. A printing press as claimed in claim 1, wherein said second threaded rod has a stop nut which is connected threadably to said second end portion thereof and which abuts against said distal vertical end face of said one of said mounting walls.

5. A printing press comprising:

two opposite mounting walls formed with aligned openings wherein a second one of said mounting walls has a distal vertical end face and a periphery which defines said opening and which includes two opposite vertical walls;

two sliding seats mounted slidably and respectively in said openings wherein a second one of said sliding seats has a first side opposite a first one of said vertical walls and a second side opposite a second one of said vertical walls;

a printing roller having a longitudinal axis extending between said mounting walls and further having two opposite ends mounted rotatably and respectively to said sliding seats;

a printing plate unit mounted on said printing roller;

a first retaining assembly provided on said first one of said mounting walls for retaining releasably a first one of said sliding seats in a desired position in the respective said opening; and a second retaining assembly provided on said second one of said mounting walls for retaining releasably said second one of said sliding seats in a desired position in the respective said opening, said second retaining assembly including a spring-loaded pin unit which is retained within the respective said opening adjacent to said first one of said vertical walls and which abuts against said first side of said second one of said sliding seats, and a threaded rod which has a first end portion that extends threadably from said distal vertical end face through said second one of said vertical walls and into the respective said opening and that abuts against said second side of said second one of said sliding seats, said threaded rod further having a second end portion that extends outside said second one of said mounting walls and that is provided with a knob;

whereby, said first and second retaining assemblies are actuated simultaneously to cause longitudinal sliding movement of said sliding seats within said openings so as to result in movement of said longitudinal axis of said printing roller relative to said mounting walls in a direction parallel to said mounting walls, actuation of said second retaining assembly without actuating said first retaining assembly causing longitudinal sliding movement of said second one of said sliding seats within the respective said opening so as to vary an angle formed between said longitudinal axis of said printing roller and said one of said mounting walls.

6. A printing press as claimed in claim 5, wherein said threaded rod has a stop nut which is connected threadably to said second end portion thereof and which abuts against said distal vertical end face of said other one of said mounting walls.

7. A printing press comprising:

two opposite mounting walls formed with aligned openings;

two sliding seats mounted slidably and respectively in said openings;

a printing roller having a longitudinal axis extending between said mounting walls and further having two opposite ends mounted rotatably and respectively to said sliding seats, wherein one of said opposite ends of said printing roller extends through one of said sliding seats and has a driving gear mounted thereon, said driving gear having an annular outer wall formed with a peripheral groove, said printing press further including a movable seat which is mounted movably on one of said mounting walls adjacent to said driving gear and which is movable toward and away from said one of said mounting walls, a coupling rod which has a first end portion connected to said movable seat and a second end portion extending into said peripheral groove of said driving gear such that movement of said movable seat results in corresponding movement of said driving gear and said printing roller in a direction perpendicular to said one of said mounting walls, and a third retaining assembly for retaining releasably said movable seat in a desired position relative to said one of said mounting walls;

a printing plate unit mounted on said printing roller;

a first retaining assembly provided on said one of said mounting walls for retaining releasably a first one of said sliding seats in a desired position in the respective said opening; and a second retaining assembly provided on said other one of said mounting walls for retaining releasably a second one of said sliding seats in a desired position in the respective said opening;

whereby, said first and second retaining assemblies are actuated simultaneously to cause longitudinal sliding movement of said sliding seats within said openings so as to result in movement of said longitudinal axis of said printing roller relative to said mounting walls in a direction parallel to said mounting walls, actuation of said second retaining assembly without actuating said first retaining assembly causing longitudinal sliding movement of said second one of said sliding seats within the respective said opening so as to vary an angle formed between said longitudinal axis of said printing roller and said one of said mounting walls.

8. A printing press as claimed in claim 7, wherein said second end portion of said coupling rod has a bearing mounted thereon, said bearing having an outer face in contact with said driving gear.

9. A printing press as claimed in claim 7, wherein said third retaining assembly includes an adjusting rod which has a threaded end portion connected threadably to said one of said mounting walls and a head portion connected to said movable seat, said adjusting rod being rotatable so as to result in movement of said movable seat toward or away from said one of said mounting walls.

10. A printing press as claimed in claim 7, wherein said movable seat has two vertically extending locking holes formed therethrough, said first end portion of said coupling rod having two longitudinally extending adjusting slots which are aligned correspondingly with said locking holes, said movable seat including two locking bolts, each of said locking bolts extending through a respective one of said adjusting slots and into a respective one of said locking holes so as to secure releasably said coupling rod to said movable seat.

* * * * *